US009189896B2

(12) United States Patent
Ghoneim et al.

(10) Patent No.: US 9,189,896 B2
(45) Date of Patent: Nov. 17, 2015

(54) METHOD AND SYSTEM FOR VEHICULAR DATA COLLECTION

(71) Applicant: GM GLOBAL TECHNOLOGY OPERATIONS LLC, Detroit, MI (US)

(72) Inventors: Youssef A. Ghoneim, Rochester, MI (US); Mutasim A. Salman, Rochester Hills, MI (US); Mark N. Howell, Rochester Hills, MI (US); Yilu Zhang, Northville, MI (US); Scott W. Otterson, Clinton Township, MI (US)

(73) Assignees: GM GLOBAL TECHNOLOGY OPERATIONS LLC, Detroit, MI (US); GENERAL MOTORS LLC, Detroit, MI (US)

( * ) Notice: Subject to any disclaimer, the term of this patent is extended or adjusted under 35 U.S.C. 154(b) by 59 days.

(21) Appl. No.: 14/097,543

(22) Filed: Dec. 5, 2013

(65) Prior Publication Data

US 2015/0161825 A1 Jun. 11, 2015

(51) Int. Cl.
*G07C 5/00* (2006.01)

(52) U.S. Cl.
CPC ..... *G07C 5/008* (2013.01)

(58) Field of Classification Search
CPC ..... G07C 5/008; G07C 5/00; G07C 5/006; G08G 1/01; G06F 17/00
USPC ..... 701/29.1
See application file for complete search history.

(56) References Cited

U.S. PATENT DOCUMENTS

| | | | | |
|---|---|---|---|---|
| 8,019,501 | B2 * | 9/2011 | Breed | 701/31.9 |
| 8,036,788 | B2 * | 10/2011 | Breed | 701/31.9 |
| 8,457,833 | B2 * | 6/2013 | Hagenbuch | 701/29.1 |
| 8,928,495 | B2 * | 1/2015 | Hassib et al. | 340/933 |

* cited by examiner

*Primary Examiner* — Richard Camby
(74) *Attorney, Agent, or Firm* — Ingrassia Fisher & Lorenz, P.C.

(57) ABSTRACT

Methods and systems are provided for vehicular communications. The systems include a server and a controller in a vehicle. The controller is configured to receive data from vehicular components and transmit the data to the remote server. In a normal mode, the data is transmitted in accordance with a normal frequency of events, while in an abnormal mode, the data is transmitted in accordance with an abnormal frequency of events. The abnormal frequency is different from the normal frequency. The abnormal mode is set in response to an event trigger denoting a fault of at least one component.

19 Claims, 2 Drawing Sheets

METHOD AND SYSTEM FOR VEHICULAR DATA COLLECTION

TECHNICAL FIELD

The technical field generally relates to data collection, and more particularly relates to collecting and transmitting data regarding components of a vehicle.

BACKGROUND

Modern vehicles utilize sophisticated computer technology to monitor operations of the vehicle and its components. Sensors routinely amass data on voltages, currents, pressures, temperatures, fluid levels, and other important factors regarding vehicle operation. While much of this data is used by on-board vehicular controllers, it is also advantageous to transmit data to remote servers. As such, long-term data trends can be efficiently monitored and/or compared with other vehicles.

One typical technique for offloading this data from the vehicle is via cellular telephone and data systems. However, such systems have a limited, finite amount of available resources, often referred to as "bandwidth". Moreover, the cost of transmitting data over such systems corresponds to the amount of data. The amount of data produced and transmitted by millions of vehicles would be cost prohibitive and consume a large amount of cellular system bandwidth.

Accordingly, it is desirable to provide systems and methods for reducing the amount of data transmitted from the vehicle. Furthermore, other desirable features and characteristics of the present invention will become apparent from the subsequent detailed description and the appended claims, taken in conjunction with the accompanying drawings and the foregoing technical field and background.

SUMMARY

A method is provided for vehicular data collection. In one embodiment, the method includes collecting data regarding at least one component of a vehicle. The method also includes transmitting the data from the vehicle to a remote server in accordance with a normal frequency of events in a normal mode. The method further includes setting an abnormal mode in response to an event trigger denoting a fault of at least one component of the vehicle. The method also includes transmitting the data from the vehicle to a remote server in accordance with an abnormal frequency of events in the abnormal mode, wherein the abnormal frequency of events is different than the normal frequency of events.

A system is also provided for vehicular data collection. In one embodiment, the system includes a server. The system also includes a controller in communication with at least one component of the vehicle and disposed remotely from said server. The controller is configured to receive data from at least one component of the vehicle. The controller is also configured to transmit the data from the vehicle to said server in accordance with a normal frequency of events in a normal mode. The controller is further configured to set an abnormal mode in response to an event trigger denoting a fault of at least one component of the vehicle. The controller is also configured to transmit the data from the vehicle to the server in accordance with an abnormal frequency of events in the abnormal mode, wherein the abnormal frequency of events is more frequent than the normal frequency of events.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

Figure 1:
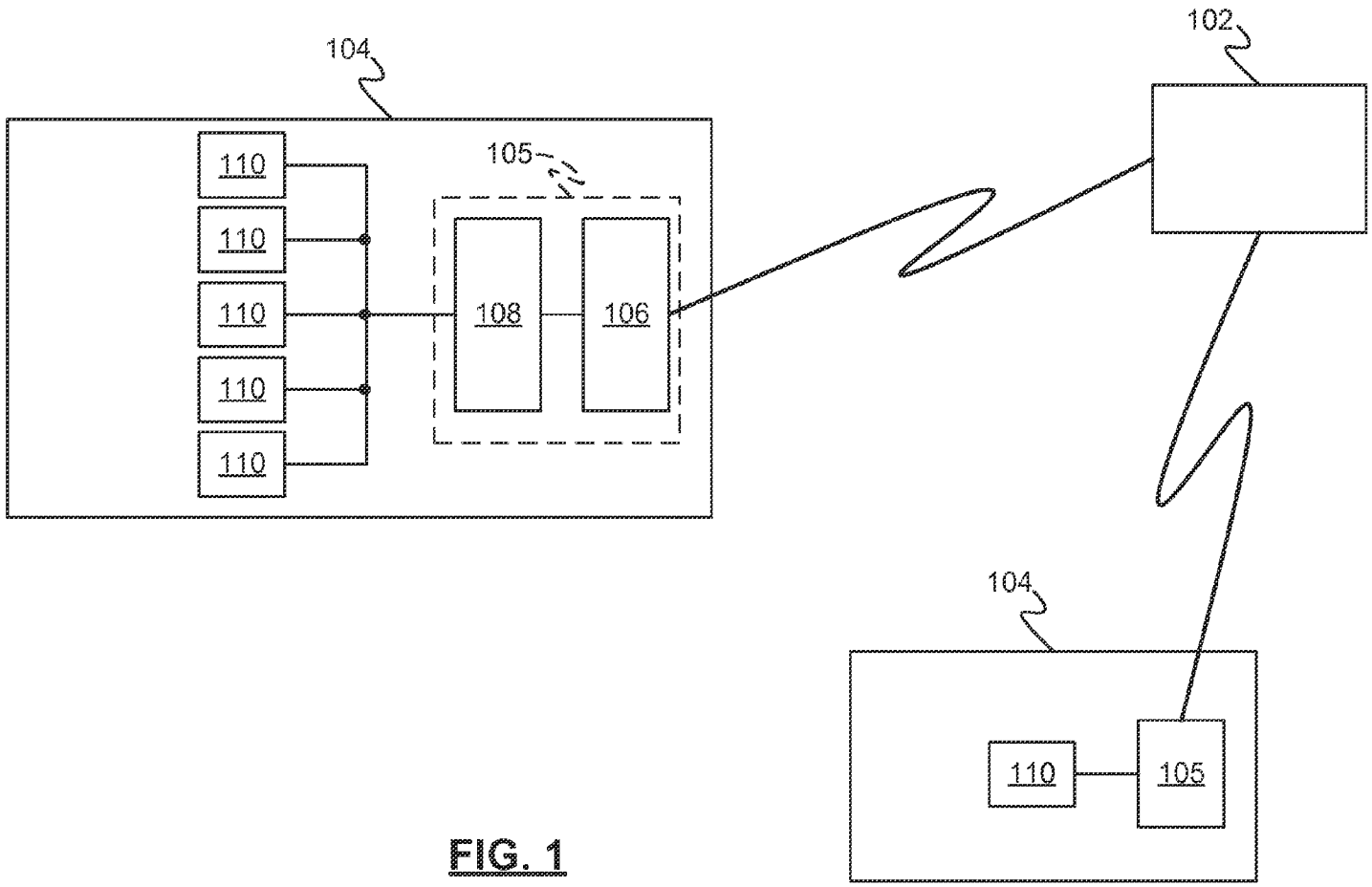
FIG. 1 is a schematic block diagram of a system for data collection in accordance with an embodiment.

Referring to FIG. 1, a system 100 for data collection is shown. The system 100 includes a server 102 for collecting data from one or more vehicles 104. The server 102 is a computerized device configured to receive and process data, as is widely appreciated by those skilled in the art. In the exemplary embodiments, the vehicles 104 are automobiles. However, the system 100 may easily be configured to collect data from other types of vehicles 104, including, but certainly not limited to, motorcycles, aircraft, trains, and boats. The vehicles 104 are typically disposed remote from the server 102.

The system 100 includes a controller 105. In the exemplary embodiment shown in FIG. 1, the controller 105 includes a communications control unit 106 and a vehicle control unit 108. Those skilled in the art appreciate that the vehicle control unit 108 may be alternatively referred to as an electronic control unit or "ECU". It should be noted that separate control units 106, 108 are not necessary for operation of the system 100. Instead, the vehicle control unit 108 and the communications control unit 106 of the controller 105 may be implemented a single device. Conversely, the operation and function of each the control units 106, 108 may be spread out over multiple devices.

The vehicle control unit 108 of the exemplary embodiment is in communication with at least one component 110 of the vehicle 104. The vehicle control unit 108 may be configured to control operation of each component 110, send data to the component 110, and/or receive data from the component 110. The at least one component 110 of the vehicle 104 may include any apparatus or device that is part of, or carried by, the vehicle 104. For instance, the components 110 may include, but are certainly not limited to, the engine, the air conditioning system, the battery, the starter, the fuel system, and the entertainment system (e.g., the radio).

The vehicle control unit 108 of the exemplary embodiment includes at least one microprocessor (not shown) for executing a series of instructions (i.e., a program), storing data, and processing data. The communications control unit 106 of the exemplary embodiment also includes at least one microprocessor (not shown) for executing a series of instructions (i.e., a program), storing data, and processing data. In the exemplary embodiment shown in FIG. 1, the communications control unit 106 is in communications with the vehicle control unit 108. Data may be transferred between the vehicle control unit 108 and the communications control unit 106. As such, data regarding the components 110 of the vehicle 104 may be transferred from the vehicle control unit 108 to the communications control unit 106.

The communications control unit 106 is configured for communications with the server 102. In the exemplary embodiment, communications between the communications control unit 106 and the server 102 is achieved, at least in part, via wireless techniques. More specifically, in the exemplary embodiment, these communications are achieved at least in part by radio frequency ("RF") techniques via a cellular telephone network (not shown). Of course, other techniques for facilitating communications between the communication control unit 106 and the server 102 are very well appreciated by those skilled in the art.

Figure 2:
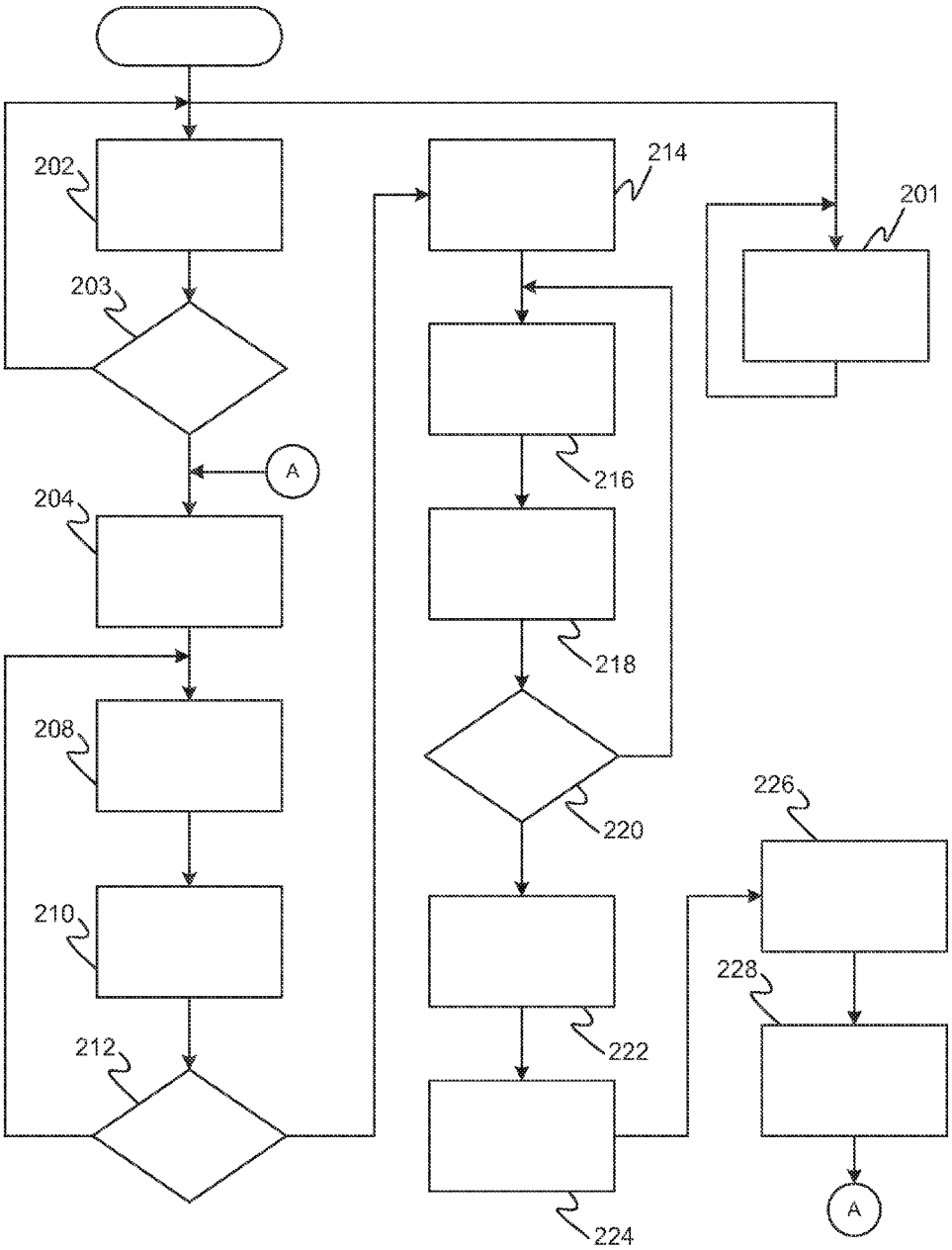
FIG. 2 is a flowchart illustrating a method for data collection in accordance with an embodiment.

The controller 105 may be configured to execute one or more programs for transferring data regarding operation of the vehicle 104 to the server 102. Specifically, the controller 105 may be configured to implement a method 200 of data collection as shown in FIG. 2. More specifically, a first exemplary embodiment of the method 200 is shown in FIG. 2. Other embodiments, of course, are possible as described herein.

The method 200 includes a plurality of operating modes. In the first exemplary embodiment, three modes are defined: a baseline mode, a normal mode, and an abnormal mode. It should be appreciated that the labeling of the modes (i.e., "baseline", "normal", and "abnormal") is done merely to differentiate one mode from another. That is, no limitations or restrictions should be read-in to the modes based on the label of the mode.

The method 200 includes at 201 collecting data regarding at least one component 110 of the vehicle 104. Collecting data at 201 may occur in any of the modes. The controller 105 may store data collected from the components 110.

In the embodiment shown in FIG. 2, the method 200 includes at 202 setting the baseline mode. Specifically, this baseline mode is set when the vehicle 104 is new, i.e., during the initial startup process of the vehicle 104. Of course, the method 200 may implement setting the baseline mode at 202 under other conditions as well.

During the baseline mode, the controller 105 collects data from the components 110 regarding operation of the components 110. The controller 105 may then calculate baseline values regarding normal operation of the components 110. It should be appreciated setting the baseline mode at 202 need not be implemented in all embodiments of the method 200 and the system 100. For instance, the baseline values may be predetermined (e.g., factory set) and stored in the controller 105 prior to operation of the vehicle 104.

Referring again to FIG. 2, the method 200 of the first exemplary embodiment includes at 204 setting the normal mode. In one example, setting the normal mode is performed after the baseline mode. In the first exemplary embodiment, the normal mode is set after determining if a predetermined time in the baseline mode has elapsed at 203. In another example, the normal mode is set after a predetermined amount of data from the components 110 is collected.

The method 200 further includes at 208 transmitting the data from the vehicle 104 to the remote server 102 in the normal mode. More specifically, transmitting the data at 208 is performed in accordance with a normal frequency of events in the normal mode.

In the first exemplary embodiment, the events are ignition starts of the vehicle 104. That is, the events are when the engine (not shown) of the vehicle 104 is started for the first time from a non-running state. Said another way, the events are when the engine of the vehicle 104 is started. In this first exemplary embodiment, the normal frequency is once every thirty events. As such, in the normal mode, data regarding components 110 is sent to the server 102 once every thirty times the engine of the vehicle 104 is started. It should be noted that this normal frequency is merely exemplary, as any desired frequency of transmission may be employed.

Of course, the normal frequency and the type of events may be different in other embodiments. For example, in another exemplary embodiment, the events are miles driven by the vehicle 104. In this other embodiment, the normal frequency of transmitting data may be once every 500 miles. In yet another exemplary embodiment, the events may be periods of operating time of the vehicle. For example, the normal frequency of transmitting data may be once every four hours of operation of the vehicle 104. Other suitable events will be realized by those skilled in the art.

The method 200 also includes at 210 analyzing the data from the components 110. In one example, the data is analyzed to determine if a fault has occurred within any of the components 110, based on the stored baseline values for the respective components 110. For example, if it is sensed that a component 110, such as an engine starter draws more current than a predetermined current, then a fault for the component 110, in this example, the engine starter may be indicated. In the exemplary embodiments, when a fault is determined, an event trigger is set by the controller 105.

The method 200 further includes at 212 determining whether or not an event trigger has been set and at 214 setting the abnormal mode in response to an event trigger. That is, the abnormal mode is set when an event trigger denotes a fault of at least one component 110 of the vehicle 104. The method 200 also includes at 216 transmitting the data from the vehicle 104 to the remote server 102 in accordance with an abnormal frequency of events in the abnormal mode.

The abnormal frequency of events is different than the normal frequency of events. In the exemplary embodiments, the abnormal frequency of events is greater than the normal frequency of events, such that the abnormal frequency of events is more frequent than the normal frequency of events. As such, the data from the one or more components 110 is transmitted to the remote server 102 more frequently in the abnormal mode than in the normal mode.

In the first exemplary embodiment, the abnormal frequency of events is at every ignition start of the vehicle. That is, each time the vehicle 104 is started, the controller 105 transmits the collected data to the remote server 102. Of course, other embodiments may dictate other frequencies and/or events for transmitting the data to the server 102.

By transmitting data at a less frequent rate in the normal mode than in the abnormal mode, wireless spectrum is conserved when the components 110 of the vehicle 104 are running normally. Thus, cellular networks are less taxed. Moreover, significant cost savings may be achieved by using less wireless spectrum, especially when millions of vehicles 104 are utilizing the wireless network. Furthermore, the infrastructure for the server 102 may be reduced due to the lower data transmission rate.

The method 100 may also include at 218 determining a severity level of the fault of the component 110 from a plurality of severity levels. The number of severity levels may be based on numerous factors, such as the type of component 110, the time of service of the component 110, and the expected lifespan of the component 110. Of course, other factors may be utilized in setting the number of severity levels.

For purposes of illustration, the exemplary embodiments utilize three severity levels: a first severity level, a second severity level, and a third severity level. In these exemplary embodiments, the first severity level corresponds to a least severe condition, the second severity level corresponds to an intermediate severe condition, and the third severity level corresponds to a most severe condition. The highest severity level may also be referred to as a maximum severity level, which corresponds to a predetermined highest acceptable level of severity for the component 110.

In one embodiment, the determination of the severity level is accomplished by comparing the particular data to a plurality of threshold levels. In this embodiment, each threshold level corresponds to one of the severity levels, e.g., a first threshold level, a second threshold level, and a third threshold level. For example, if the measured data is greater than the first threshold level, but less than the second threshold level, then the first severity level is set. Likewise, if the measured data is greater than the second threshold level, but less than the third threshold level, then the second severity level is set. Finally, if the measured data is greater than the third threshold level, then the third severity level is set. Other embodiments may utilize different criteria for determining the severity level.

Transmitting the data at 216 from the vehicle 104 to a remote server 102 in the abnormal mode may be performed for a certain number of events based on the severity level of the fault. In the first exemplary embodiment, when the first severity level is set, the data is transmitted from the vehicle 104 to the server 102 for three consecutive ignition starts of the vehicle 104. When the second severity level is set, the data is transmitted for 20 consecutive ignition starts. When the third severity level is set, the data is transmitted for 60 consecutive ignition starts. Of course, in other embodiments, the number of events may be different, based on any number of factors.

The method 100 may include at 220 determining if the certain number of events has been reached. If the certain number of events has not been reached, then the method 100 continues with transmitting the data at the abnormal frequency in the abnormal mode.

The method 100 may also include at 222 changing at least one of the threshold levels. In the first exemplary embodiment, the threshold levels for a component 110 may be changed when that component 110 triggers the setting of the abnormal mode. More specifically, in the first exemplary embodiment, the threshold levels are lowered for components 110 which frequently trigger the setting of the abnormal mode. This allows the number of events in which the higher frequency of transmission to be increased in the case of reoccurring faults that do not necessarily increase in severity. However, in other instances, the threshold levels may be lowered in case of a new higher "normal" threshold levels.

The method 100 may also include at 224 sending a message to a user in response to the determined severity level being equal to the maximum severity level, i.e., the highest severity level. The user may include, but is certainly not limited to, the driver of the vehicle 104, the owner of the vehicle 104, a mechanic, and a service advisor. Numerous techniques may be employed to send the message to the user. These techniques include, but are not limited to, displaying a message in the vehicle 104, illuminating a light in the vehicle 104, sending an email to the user, sending a text message to the user, and initiating a phone call between the service advisor and the owner of the vehicle 104.

The method 100 may further include at 226 ceasing transmitting data regarding the component 110 in response to the determined severity level being equal to the maximum severity level. Said another way, data related to a faulted component 110 will be stopped at a maximum severity level. Ceasing transmission of data in this fashion conserves wireless spectrum and saves costs. This is particularly beneficial when a component 110 is known to have failed and continually transmitting data regarding a known failed component is no longer useful. In addition to, or as an alternative to ceasing transmitting data regarding the component 110, the method 100 may also include ceasing collecting data regarding the component 110.

The method 100 also includes at 228 setting the normal mode in response to a number of events being greater than or equal to a predetermined number of events while in the abnormal mode. That is, after a certain number of events have occurred, based on the severity level, and the corresponding data transmissions have been sent, the normal mode is reestablished. Of course, when the normal mode is reestablished, the different frequency of data transmissions from the vehicle 104 to the server 102 is also reestablished. For example, after the data regarding the component 110 has been sent at every ignition cycle in for twenty cycles in the second severity level of the abnormal mode, the data regarding the component 110 is then only sent once every thirty ignition cycle.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for vehicular data collection, comprising:

collecting data regarding at least one component of a vehicle;

transmitting the data from the vehicle to a remote server in accordance with a normal frequency of events in a normal mode;

setting an abnormal mode in response to an event trigger denoting a fault of at least one component of the vehicle; and transmitting the data from the vehicle to a remote server in accordance with an abnormal frequency of events in the abnormal mode, wherein the abnormal frequency of events is more frequent than the normal frequency of events, such that the data is transmitted from the vehicle to the remote server more frequently in the abnormal mode than in the normal mode.

2. The method as set forth in claim 1, wherein the events comprise ignition starts of the vehicle.

3. The method as set forth in claim 1, wherein the events comprise miles driven.

4. The method as set forth in claim 1, wherein the events comprise time periods.

5. The method as set forth in claim 2, wherein the abnormal frequency of events is further defined as every ignition start of the vehicle.

6. The method as set forth in claim 1, further comprising determining a severity level of the fault of the component from a plurality of severity levels.

7. The method as set forth in claim 6, wherein the transmitting of the data from the vehicle to a remote server in the abnormal mode is performed for a predetermined number of events based on the severity level of the fault.

8. The method as set forth in claim 6, wherein the plurality of severity levels for the component includes a maximum severity level corresponding to a predetermined highest acceptable level of severity for the at least one component.

9. The method as set forth in claim 8, further comprising sending a message to a user in response to the determined severity level being equal to the maximum severity level.

10. The method as set forth in claim 9, further comprising ceasing transmitting data regarding the at least one component in response to the determined severity level being equal to the maximum severity level.

11. The method as set forth in claim 1, further comprising setting the normal mode in response to a number of events being greater than or equal to a predetermined number of events while in the abnormal mode.

12. A system for vehicular data collection, comprising:

a server; and a controller in communication with at least one component of a vehicle and disposed remotely from said server, said controller configured to receive data from the at least one component of the vehicle, transmit the data from the vehicle to said server in accordance with a normal frequency of events in a normal mode, set an abnormal mode in response to an event trigger denoting a fault of the at least one component of the vehicle, and transmit the data from the vehicle to said server in accordance with an abnormal frequency of events in the abnormal mode, wherein the abnormal frequency of events is more frequent than the normal frequency of events, such that the data is transmitted from the vehicle to the remote server more frequently in the abnormal mode than in the normal mode.

13. The system as set forth in claim 12, wherein said controller is further configured to determine a severity level of the fault of the at least one component from a plurality of severity levels, while in the abnormal mode.

14. The system as set forth in claim 13, wherein said controller is further configure to transmit the data from the vehicle to a remote server for a predetermined number of events based on the severity level of the fault, in the abnormal mode.

15. A vehicle, comprising:

at least one component; and a controller in communication with said at least one component and configured to receive data from said at least one component of the vehicle, transmit the data from the vehicle to a remote server in accordance with a normal frequency of events in a normal mode, set an abnormal mode in response to an event trigger denoting a fault of said at least one component of the vehicle, and transmit the data from the vehicle to a remote server in accordance with an abnormal frequency of events in the abnormal mode, wherein the abnormal frequency of events is more frequent than the normal frequency of events, such that the data is transmitted from the vehicle to the remote server more frequently in the abnormal mode than in the normal mode.

16. The vehicle as set forth in claim 15, wherein said controller is further configured to determine a severity level of the fault of said component from a plurality of severity levels, while in the abnormal mode.

17. The vehicle as set forth in claim 16, wherein said controller is further configured to transmit the data from the vehicle to a remote server for a predetermined number of events based on the severity level of the fault, in the abnormal mode.

18. The vehicle as set forth in claim 16 wherein the events comprise ignition starts of the vehicle.

19. The vehicle as set forth in claim 16, wherein said at least one component comprises an engine starter.

* * * * *